United States Patent [19]

Miller

[11] Patent Number: 4,756,674

[45] Date of Patent: Jul. 12, 1988

[54] RECIPROCATING GAS COMPRESSOR HAVING A SPLIT HOUSING AND CROSSHEAD GUIDE MEANS

[75] Inventor: Bernard F. Miller, Corning, N.Y.

[73] Assignee: Ingersoll-Rand Company, Woodcliff Lake, N.J.

[21] Appl. No.: 88,364

[22] Filed: Aug. 24, 1987

[51] Int. Cl.[4] ..... F04B 21/02; F04B 41/06

[52] U.S. Cl. ..... 417/534; 74/49

[58] Field of Search ..... 417/521, 534, 535, 536, 417/538, 265, 267, 571; 92/138, 139, 165 R; 74/49, 606 R

[56] References Cited

U.S. PATENT DOCUMENTS

| | | | |
|---|---|---|---|
| 2,288,963 | 7/1942 | Von Tavel | 74/49 |
| 3,010,644 | 11/1961 | Zeidler | 417/534 |
| 4,615,259 | 10/1986 | Anbe | 417/536 |

FOREIGN PATENT DOCUMENTS

| | | | |
|---|---|---|---|
| 2821389 | 11/1978 | Fed. Rep. of Germany | 417/534 |

OTHER PUBLICATIONS

Ingersoll-Rand Company, ES-2 and FS-2 Heavy-Duty Two-Stage Compressors, 12/24/1934.

*Primary Examiner*—Leonard E. Smith
*Assistant Examiner*—Leonard P. Walnoha
*Attorney, Agent, or Firm*—B. J. Murphy

[57] ABSTRACT

The compressor has a crankcase which is horizontally separable and has piston cylinders removably coupled to opposite ends thereof. The crankcase confines a pair of tie-rod-joined crossheads therein, and guides control reciprocation of the crossheads in horizontal and vertical planes. Inlet and discharge valves are all accessibly fastened to the cylinders, and oil buffers and gas seals set about piston rods inhibit insinuation of oil into the cylinders, and gas into the crankcase.

13 Claims, 3 Drawing Sheets

RECIPROCATING GAS COMPRESSOR HAVING A SPLIT HOUSING AND CROSSHEAD GUIDE MEANS

This invention pertains to gas compressors, and in particular to a gas compressor (a) capable of providing low gas pressures and high gas pressures, (b) of compact design, (c) easily maintainable, and (d) internally sealed and buffered to keep the product gas out of the crankcase, and the lubrication oil out of the cylinders.

There exists a need for air and special gas compressors, of the aforesaid types to provide both high and low pressures and that fit into small spaces. They must also be easily maintained and the crankcase, which contains the drive mechanism, must be sealed from contaminants in the gases, and allow oil-free operation in the compressor cylinders.

It is an object of this invention to set forth just such a long-sought gas compressor.

It is particularly an object of this invention to set forth a reciprocating gas compressor, having a split housing and crosshead guide means, comprising a crankcase; said crankcase being subdivided, having separate portions with mating surfaces; and means fastening said mating surface of one of said portions to said mating surface of another of said portions; and further including a pair of crossheads confined within said crankcase; means fastening said crossheads together, in spaced-apart disposition, for common reciprocation; a crankshaft journalled in said crankcase; a connecting rod coupled, at opposite ends thereof, to said crankshaft and to one of said crossheads; wherein said crossheads and said mating surfaces have first means cooperative for guiding said crossheads for reciprocation in a given horizontal plane; said crossheads and one of said portions have second means cooperative for guiding said crossheads for reciprocation in a vertical plane; and including end housings fastened to opposite ends of said crankcase; said housings comprising cylinders; each cylinder having (a) valved gas inlet and discharge parts, and (b) a piston reciprocable therein; and means coupling said pistons to said crossheads.

Further objects of this invention, as well as the novel features thereof, will become more apparent by reference to the following description taken in conjunction with the accompanying figures, in which.

Figure 1:
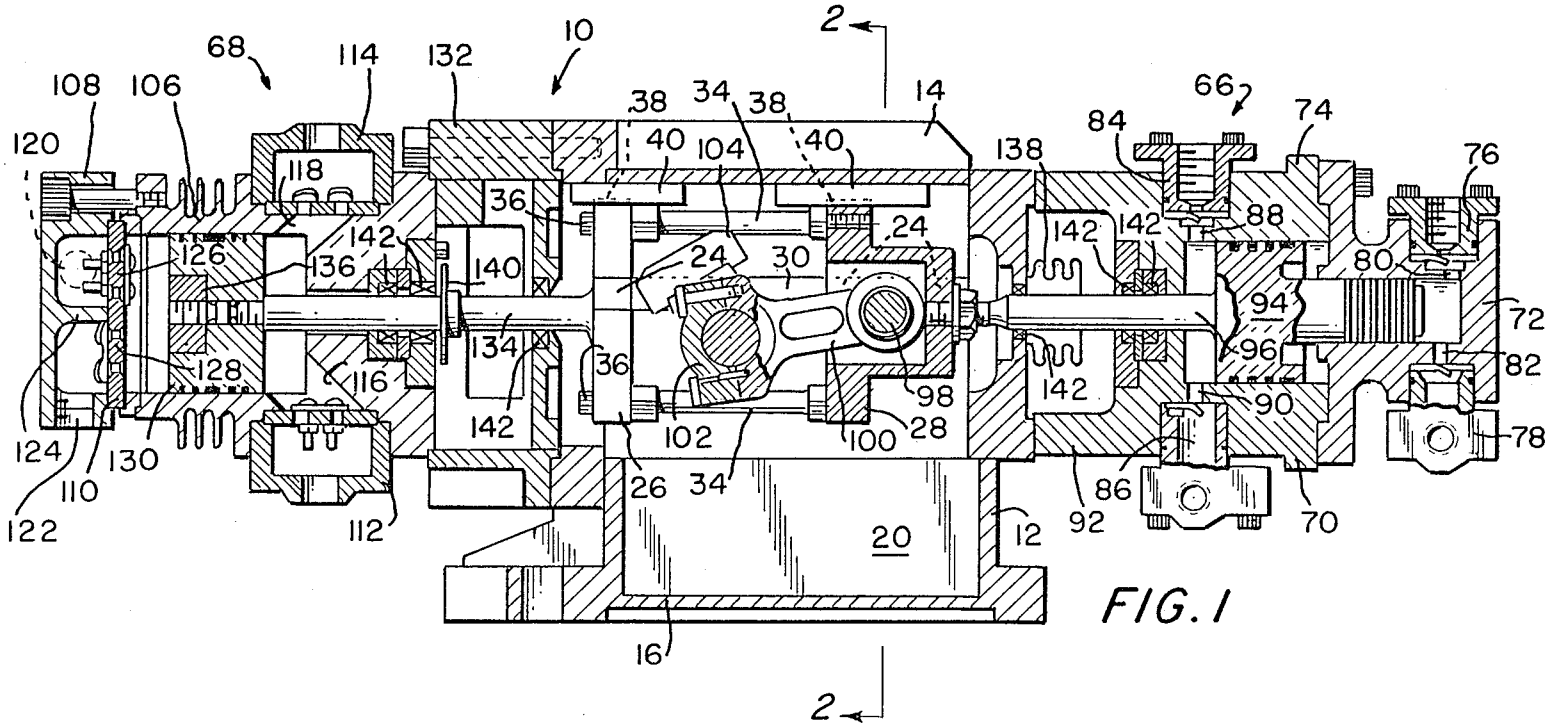
FIG. 1 is a cross-sectional view, taken substantially along the longitudinal axis of an embodiment of the novel compressor according to the invention.
Figure 3:
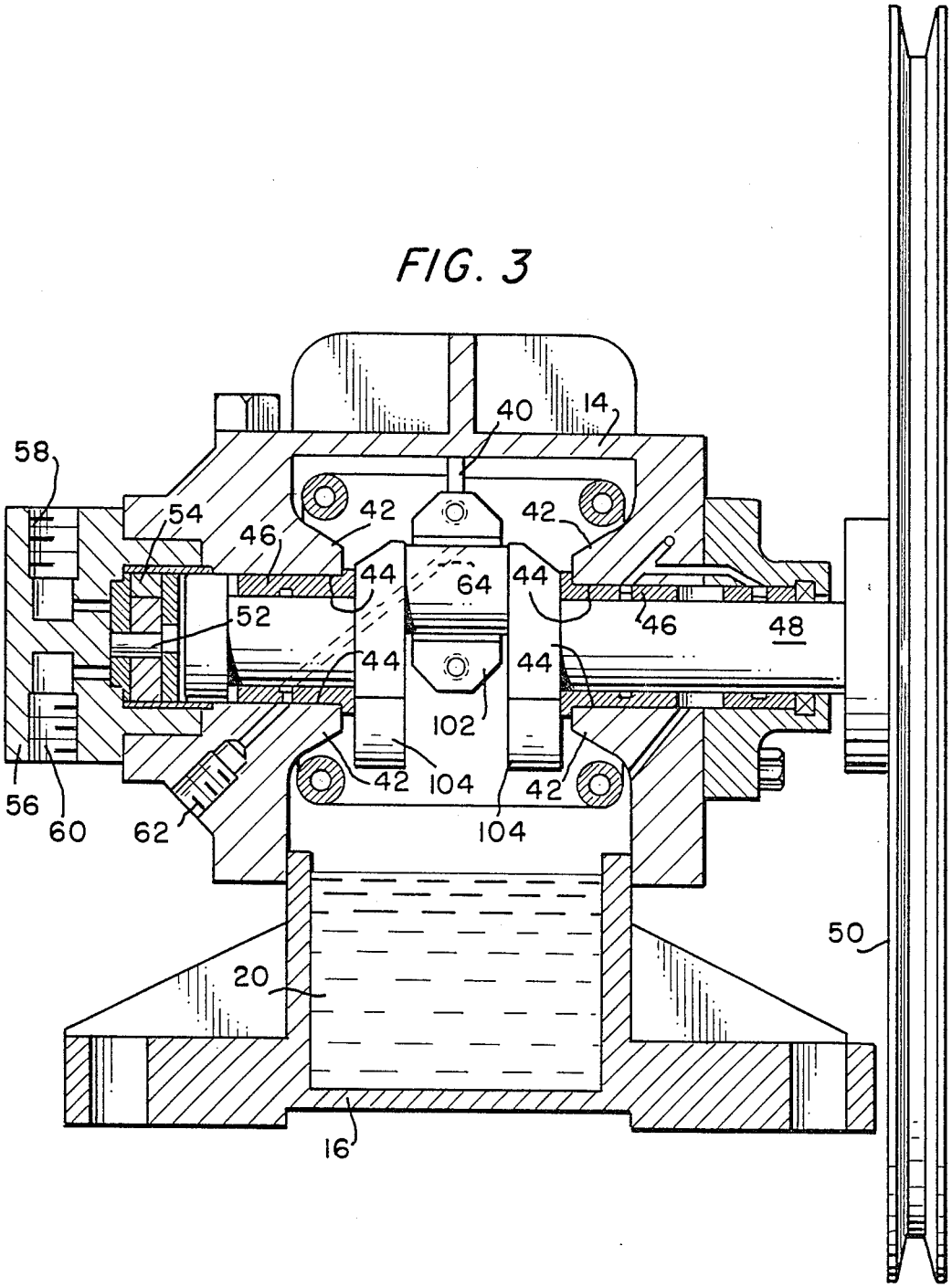
FIG. 3 is a cross-sectional view of the FIGS. 1 and 2 embodiment taken, generally, along the crankshaft.
Figure 2:
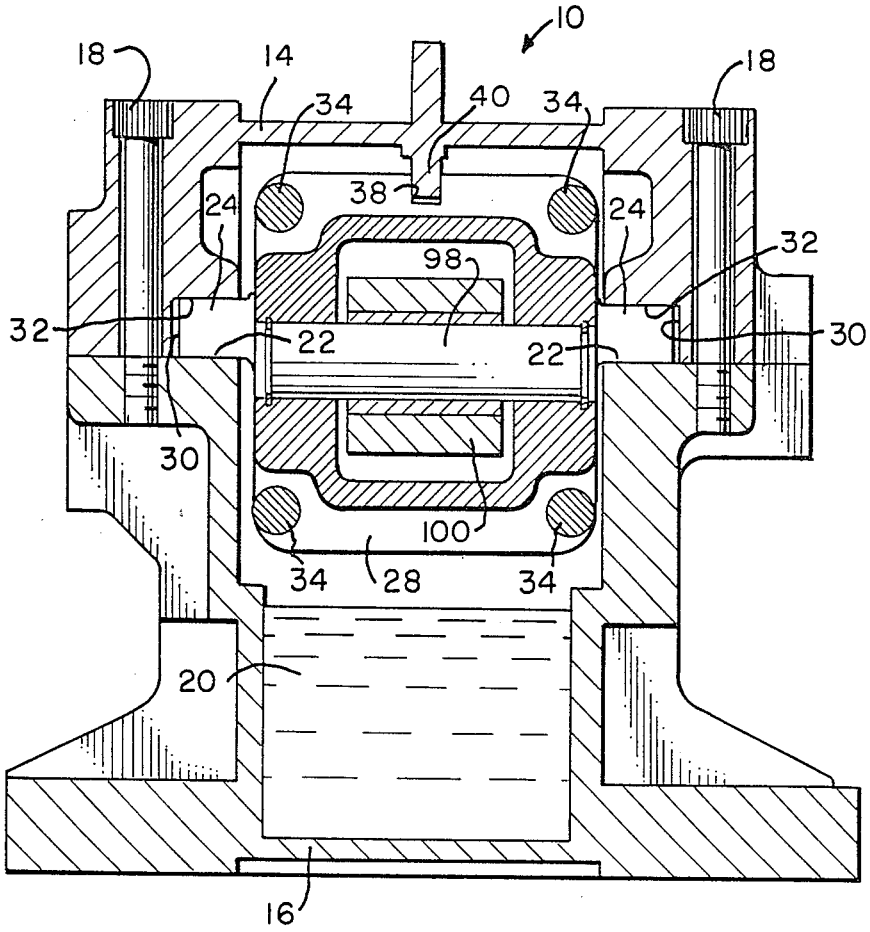
FIG. 2 is a cross-sectional view taken along section 2—2 of FIG. 1.

As shown in the figures, the novel compressor 10 has a crankcase 12 formed of two, mating halves 14 and 16. The halves have mating surfaces which are fastened together by four bolts 18 (only two of which are shown). Half or portion 16 comprises an oil sump 20, and its upper, mating surface 22 defines a land for slidably receiving guiding slides 24. Slides 24 project outwardly from crossheads 26 and 28, and travel along channels 30 in the crankcase 12. Half or portion 14 has troughs 32, formed in the edges thereof, which mate with surface 22, which cooperate with the latter surface to define the channels 30. Slides 24, then, guide the crossheads 26 and 28 for reciprocation in a given horizontal plane.

The crossheads 26 and 28 are secured together by tie rods 34. The rods 34 are threadedly fastened into tapped holes provided therefor in crosshead 28 by means of the wrench flats adjacent the ends thereof. The latter ends are tapped and receive cap screws 36 to fasten the rods to crosshead 26. The crossheads 26 and 28 have axially-extending grooves 38, formed in the uppermost surfaces thereof, slidably and guidably to receive ribs 40 projecting downwardly from within the top of portion 14. Grooves 38 and ribs 40 guide the crossheads 26 and 28 for reciprocation in a given vertical plane.

Portions 14 and 16 of the crankcase 12, intermediate the lengths thereof, have semi-circular bosses 42 projecting inwardly, and each of the bosses 42 have semi-circular coves 44 formed therein. The latter interface to define fully circular voids in which to receive sleeve bearings 46, and to journal the crankshaft 48. One end of the crankshaft is joined to a fan belt sheave 50, and the opposite end terminates in an eccentric pin 52. Pin 52 drives an oil pump 54 coupled to crankcase portions 14 and 16. An outer casing 56 has ports 58 and 60 for admitting oil to the pump 54 and for discharging pumped oil from the pump 54, respectively. With the use of external tubing (not shown) pumped oil is conveyed to an admittance port 62 for supply of the oil to crankshaft channeling 64 and the bearings 46.

At opposite ends of the crankcase 12 are cylinder assemblies 66 and 68. Assembly 66 comprises a tandem, single-acting cylinder 70 formed of two parts, an outer structure 72 defining a small-diameter cylinder, and an inner structure 74 defining a larger-diameter cylinder. Inlet and outlet valves 76 and 78, respectively, are removably fastened to structure 72 for communication with gas inlet and discharge ports 80 and 82. Structure 74, too, has inlet outlet valves 84 and 86, respectively, which communicate with gas inlet and discharge ports 88 and 90. The structure 74 also serves as a distance piece 92 which, as seen in FIG. 1, is fastened to one end of the crankcase 12.

A tandem piston 94 is reciprocable in the cylinders of structures 72 and 74, and its rod 96 traverses this distance piece 92. The terminal end of the rod 96 is coupled to the crosshead 28. A crosshead pin 98 couples an end of a connecting rod 100 to crosshead 28. The opposite end of connecting rod 100 is coupled to the crank of crankshaft 48 by means of a cap 102. Two counterweights 104 are fastened to the crankshaft 48 to provide for balance thereof during operation.

Cylinder assembly 68 comprises a single, double-acting cylinder formed of a principal structure 106, and a valve housing 108, with a valving plate 110 therebetween. Structure 106 has inlet and discharge valves 112 and 114, respectively, coupled thereto for communication with gas inlet and discharge ports 116 and 118. Too, valve housing 108 has inlet and discharge ports 120 and 122, respectively, formed therein and separated by a dividing wall 124 which compartments the housing 108. One of the compartments communicates with an inlet valve 126, and the other communicates with an outlet valve 128. Valving plate 110 carries the valves 126 and 128, and is set across the end of the cylinder, of structure 106, in which piston 130 is reciprocably disposed.

A distance piece 132 is secured between structure 106 and the crankcase 12, and the rod 134 of piston 130 traverses the distance piece 132. Rod 134 is integral with the crosshead 26 (in this embodiment) and is secured to the piston 130 by a round nut 136 which nests in the piston 130.

To inhibit the migration of oil from the crankcase 12 to the cylinders a flexible boot 138 is arranged in the distance piece 92 and secured to the rod 96, and a slinger 140 is disposed within distance piece 132, and carried by rod 134. Also, to inhibit the insinuation of gas into the crankcase 12 from the cylinders, seals 142 are set about the rods 96 and 134.

This novel compressor 10 satisfies the aforesaid long-sought need by close coupling the cylinders with a drive mechanism which is self contained in the crankcase 12 and sealed off from the compression cylinders with a boot 138 and oil slinger 140 operating in distance pieces 92 and 132 located between the cylinders and crankcase. Further, with the compressor 10 designed with the (frame) crankcase 12 split at the crankshaft horizontal centerline, this allows the upper half, i.e. portion 14, to act not only as a retainer for bearings 46, but also as a retainer for crosshead slides 24. In that the two crossheads 26 and 28 are connected to each other with tie rods 34, close coupling is attained. The top portion 14 of the crankcase 12 having the protruding ribs 40 which engage the crosshead grooves 38, the drive mechanism is guided in vertical direction just as slides 24 guide it in the horizontal direction. Thusly, the mechanism is closely guided in all three directions, with a minimal quantity of parts, and creates a relatively small machine able to pump gases up to high pressures with an ease of maintenance. The latter is so, because when the cylinders attachment bolts and top portion crankcase bolts are removed, all bearings, and the complete drive mechanism can be easily removed and reconditioned. Also the inertia of the drive mechanism is kept to a minimum. The compact construction allows pressures up to 3000 PSI in a unit measuring only twenty inches, by nine inches, by seven inches, in an optimum embodiment.

While I have described my invention in connection with a specific embodiment thereof, it is to be clearly understood that this is done only by way of example, and not as a limitation to the scope of my invention as set forth in the objects thereof and in the appended claims.

I claim:

1. A reciprocating gas compressor, having a split housing and crosshead guide means, comprising:

a crankcase;

said crankcase being subdivided, having separate portions with mating surfaces; and means fastening said mating surface of one of said portions to said mating surface of another of said portions; and further including a pair of crossheads confined within said crankcase;

means fastening said crossheads together, in spaced-apart disposition, for common reciprocation;

a cranakshaft journalled in said crankcase;

a connecting rod coupled, at opposite ends thereof, to said crankshaft and to one of said crossheads; wherein said crankshaft and said mating surfaces have first means cooperative for (a) guiding said crossheads for linear reciprocation, and (b) inhibiting movement of said crossheads in horizontal excursions;

said crossheads and one of said portions have second means cooperative for (a) guiding said crossheads for said linear reciprocation, and (b) inhibiting movement of said crossheads in vertical excursions;

end housings fastened to opposite ends of said crankcase; wherein said housings comprise cylinders;

each cylinder having (a) valved gas inlet and discharge ports, and (b) a piston reciprocable therein;

means coupling said pistons to said crossheads;

said first means comprises (a) slides projecting from sides of said crossheads, and (b) troughs formed in said mating surface of one of said portions;

said slides are slidably engaged with said troughs; and said troughs confront said mating surface of the other of said portions and, therewith, define channels which slidably nest said slides therein.

2. A gas compressor, according to claim 1, wherein:

said second means comprises (a) ribs projecting from said one portion, and (b) grooves formed in said cross-heads, wherein said ribs are slidably engaged with said grooves.

3. A gas compressor, according to claim 1, wherein:

said housings further comprise distance pieces interposed between said cylinders and said crankcase;

said coupling means comprises piston rods; and further including means confined within said distance pieces for inhibiting fluid flow therethrough between said crankcase and said cylinders.

4. A gas compressor, according to claim 3, wherein:

said inhibiting means comprises oil-flow barriers; and said barriers are coupled to said rods for reciprocation therewith.

5. A gas compressor, according to claim 1, wherein:

said tandem cylinder comprises two structures fastened together;

one of said structures comprises a piston cylinder having a given diameter;

the other of said structures comprises a piston cylinder of a diameter greater than said given diameter; and one of said structures further comprises a distance piece.

6. A gas compressor, accordingly to claim 1, wherein:

one of said end housings has a tandem, single-acting cylinder, with a tandem piston therein; and the other of said end housings has a single, double-acting cylinder.

7. A gas compressor, according to claim 6, wherein:

said cylinder of said other end housing has (a) a cup-shaped subhousing, the latter having a circumferential wall joined to an end base, and (b) inlet and discharge valves secured to said wall; wherein:

gas inlet and discharge ports, as aforesaid, are formed in said wall and are in communication with said valves.

8. A gas compressor, according to claim 7, wherein:

said cylinder of said other end housing further has a dished closure plate removably fastened to said circumferential wall, and a valve plate interpositioned between said closure plate and said circumferential wall; and inlet and discharge valves are secured to said valve plate.

9. A gas compressor, according to claim 8, wherein;

said closure plate has a dividing wall projecting from the center thereof which abuts said valve plate and, with said valve plate, forms compartments in said closure plate;

an inlet valve, secured to said valve plate, communicates with only one of said compartments;

an outlet valve, secured to said valve plate, communicates with only another of said compartments; and said compartments each have a peripheral wall, and a port formed through said peripheral wall for communication with one of said valves.

10. A gas compressor, according to claim 1, further including:

means interposed between said crankcase and said cylinders for inhibiting gas flow therebetween.

11. A gas compressor, according to claim 10, wherein:

said gas flow inhibiting means comprises gas seals.

12. A gas compressor, according to claim 1, wherein:

said portions, intermediate the lengths thereof, have semi-circular bosses extending therefrom inwardly toward the longitudinal center of said crankcase;

said bosses each have semi-circular coves formed therein which, matingly, define fully circular voids; and said crankshaft is journalled in said voids.

13. A gas compressor, according to claim 12, further including:

shell- or sleeve-type bearings interposed between surfaces bounding said voids and said crankshaft.

* * * * *